US006066615A

United States Patent [19]

Bijl et al.

[11] Patent Number: 6,066,615

[45] Date of Patent: May 23, 2000

[54] DETERGENT COMPOSITIONS

[75] Inventors: Henk Bijl, Vlaardingen, Netherlands; James William Gordon, Cumbria, United Kingdom; Gert van Koppen, Vlaardingen, Netherlands; Marcel Van der Kraan, Vlaardingen, Netherlands; Jan Poorvliet, Vlaardingen, Netherlands

[73] Assignee: Unilever Home & Personal Care USA division of conopco, Inc., Greenwich, Conn.

[21] Appl. No.: 09/244,002

[22] Filed: Feb. 4, 1999

[30] Foreign Application Priority Data

| | | | |
|---|---|---|---|
| Feb. 10, 1998 | [GB] | United Kingdom | 9802850 |
| Mar. 5, 1998 | [GB] | United Kingdom | 9804714 |

[51] Int. Cl.[7] ..... C11D 11/00; C11D 17/00

[52] U.S. Cl. ..... 510/446; 510/294; 510/298; 264/320; 425/406

[58] Field of Search ..... 510/446, 294, 510/298; 425/406; 264/320

[56] References Cited

U.S. PATENT DOCUMENTS

| | | | |
|---|---|---|---|
| 3,081,267 | 3/1963 | Laskey | 252/135 |
| 3,270,110 | 8/1966 | Downie et al. | 264/219 |
| 3,279,995 | 10/1966 | Reid | 167/82 |
| 3,503,889 | 3/1970 | Davis et al. | 252/138 |
| 3,534,440 | 10/1970 | Roberts | 18/16 |
| 3,557,003 | 1/1971 | Morris et al. | 252/90 |
| 3,953,350 | 4/1976 | Fujino et al. | 252/94 |
| 4,061,453 | 12/1977 | DeSantis | 425/78 |
| 4,793,959 | 12/1988 | Adams et al. | 264/320 |
| 4,820,439 | 4/1989 | Rieck | 252/135 |
| 4,822,273 | 4/1989 | Adams et al. | 425/385 |

FOREIGN PATENT DOCUMENTS

| | | |
|---|---|---|
| 221 776 | 5/1987 | European Pat. Off. . |
| 276 971 | 8/1988 | European Pat. Off. . |
| 340 013 | 11/1989 | European Pat. Off. . |
| 352 135 | 1/1990 | European Pat. Off. . |
| 367 339 | 5/1990 | European Pat. Off. . |
| 384 070 | 8/1990 | European Pat. Off. . |
| 390 251 | 10/1990 | European Pat. Off. . |
| 425 277 | 5/1991 | European Pat. Off. . |
| 522 766 | 1/1993 | European Pat. Off. . |
| 711 828 | 5/1996 | European Pat. Off. . |
| 8105065A | 6/1983 | Netherlands . |
| 746769 | 3/1956 | United Kingdom . |
| 911204 | 11/1962 | United Kingdom . |
| 1080066 | 8/1967 | United Kingdom . |
| 1 429 143 | 3/1976 | United Kingdom . |
| 2 260 989 | 5/1993 | United Kingdom . |
| 2 276 345 | 9/1994 | United Kingdom . |
| 92/06151 | 4/1992 | WIPO . |
| 96/00278 | 1/1996 | WIPO . |
| 97/20028 | 6/1997 | WIPO . |
| 98/46719 | 10/1998 | WIPO . |
| 98/46720 | 10/1998 | WIPO . |

*Primary Examiner*—Lorna M. Douyon
*Attorney, Agent, or Firm*—Rimma Mitelman

[57] ABSTRACT

A tablet of compacted particulate detergent composition has an indentation (39) around a periphery of the face (37) of the tablet. The surface circumscribed by the indentation preferably has higher permeability and is rougher than the surface of the indentation (39) itself. Such a tablet can be made by a process in which a detergent composition is compacted in a mould by at least one die with an elastomeric surface layer (36) on an area which contacts the composition, which layer (36) is surrounded by a rigid rim (30) which forms the indentation (39).

14 Claims, 2 Drawing Sheets

DETERGENT COMPOSITIONS

FIELD OF THE INVENTION

The invention relates to detergent compositions in the form of tablets, for use in fabric washing, and to a process for making such tablets by compaction of a particulate detergent composition.

BACKGROUND OF THE INVENTION AND SUMMARY OF PRIOR ART

Detergent compositions in tablet form are described, for example, in GB 911204 (Unilever) and U.S Pat. No. 3,953,350 (Kao). They are sold commercially in Spain. Tablets have several advantages over powdered products: they do not require measuring and are thus easier to handle and dispense into the washload, and they are more compact, hence facilitating more economical storage. These detergent tablets are intended to be consumed completely when washing a single load. Thus they should disperse/dissolve completely when added to water.

Detergent tablets are generally made by compressing or compacting a detergent powder, which includes both an organic detergent active surfactant and detergency builder. It is desirable that tablets have adequate strength when dry, yet disperse and dissolve quickly when added to wash water.

Such tablets can be manufactured by stamping a chosen quantity of the detergent composition using a press with steel dies (also referred to as punches) which contact the powder and apply pressure so as to compact the powder into a tablet. Such a press may for example have two dies which move together within a surrounding sleeve, or one die which is driven towards a fixed anvil, again within a surrounding sleeve.

When making tablets with any kind of material, not necessarily detergent, a problem which can arise is adhesion of the composition to the steel mould parts. Adhesion of material to mould parts is disadvantageous, because the accumulated material spoils the surface finish of articles compacted in the mould. Such adhesion also interferes with the proper operation of production machinery which is constructed so as to monitor and control the compaction force employed. The traditional approaches to this problem of adhesion have been to provide a low adhesion and low friction surface on the mould parts, e.g. a conventional non-stick coating of polytetrafluoroethylene, or else to apply a release agent, for example magnesium stearate.

U.S Pat. No. 3,081,267 teaches that the dies should rotate relative to each other while compressing the composition, so as to prevent the composition from adhering to them. GB 2276345 teaches the stamping of articles, including tablets of compacted detergent powder, using mould parts surfaced with an elastomeric material of some thickness. The document explains that a suitable modulus of elasticity can be achieved with a surface coating of elastomer which is at least 0.5 mm thick. A range of 0.5 to 7 mm is disclosed. The thicknesses which are exemplified are about 4 mm but the surface coatings are shown as tapering to edges without appreciable thickness.

WO 97/20028 (Unilever) discloses the stamping of tablets using dies which carry a thin elastomer coating, which has a thickness not exceeding 0.5 mm over much or all of its area. This overcomes the problem of adhesion to the dies, and produces tablets with a smooth surface.

In co-pending US application serial number 09/059047, also published as WO 98/46720 on Oct. 22, 1998, it is disclosed that dies which carry a thicker elastomer coating lead to an increased speed of penetration of water into the tablets on immersion, thereby accelerating the dispersion/dissolution of the tablets.

The increased speed of water penetration is believed to arise because the elastomer layer on the dies leads to a tablet surface which is more permeable, and also somewhat less smooth, than the surface obtained from clean, plain steel dies, used to produce tablets of similar strength.

SUMMARY OF THE INVENTION

According to a first aspect of the present invention, there is provided a process for the manufacture of tablets of detergent composition for fabric washing, comprising compacting a particulate detergent composition in a mould having a pair of dies which are moveable relatively towards and away from each other, at least one of the dies having an elastomeric surface layer on an area which contacts the composition (which layer preferably has a thickness of at least 0.3 mm at its periphery) wherein the periphery of the said area with elastomeric layer thereon is surrounded by a rigid rim.

This rigid rim surrounding the elastomer is preferably a metal rim integral with the main body of the die. The rim will protect the edge of the elastomer, and extend the working life of the die, thereby reducing costs and machine downtime.

Provision of a rigid rim around a piece of elastomer is subject to conflicting requirements and would be expected to create a dilemma. The rigid rim, which may well be metal, is part of the die face which contacts the detergent composition. Consequently the composition could adhere to this rim thereby reintroducing the problem of adhesion which the elastomer aimed to solve. Hence the dilemma. An attempt to protect the edge of the elastomer applied to overcome an adhesion problem could do so only at the expense of recreating the problem of adhesion.

If the rim is narrow, there is less area to adhere to, but if the elastomer has significant thickness where it adjoins the rim, then making the rim narrow also reduces its mechanical strength especially if the elastomer layer has distinct thickness at its edge adjacent the rim.

Surprisingly, we have found that a narrow rim, which is however wide enough to create a visible indentation in the tablet, can be strong enough to be efficacious, even when surrounding elastomer of distinct thickness at its edge, without re-creating the adhesion problem.

Elastomer can be moulded in situ on a die, or retained with adhesive, but a rim, as used in the present invention may also serve to retain a piece of elastomer in place on the die, making it unnecessary to mould or glue the elastomer in place, or allowing it to be glued with an adhesive which would not be strong enough in the absence of the rim.

This greatly facilitates use of an elastomer layer on a die because the elastomer can be made as an insert to go within the rim. As tablets are stamped the elastomer will wear, but worn elastomer can easily be removed and replaced with a new insert when required. An elastomer insert preferably has a thickness of at least 0.3 mm, better at least 0.5 or 1 mm over its entire area. To assist in retaining the elastomer, the rim is preferably undercut. Easy replacement of worn elastomer gives an advantage of keeping short the periods of machine downtime when changing the elastomer.

Thus the present invention provides the use of an elastomeric layer, preferably more than 0.5 mm thick—on a surface area of at least one mould part in a press for compacting particulate detergent composition into tablet form, which surface area contacts the composition during compaction—in order to enhance the penetration of water through the tablet surface on immersion; further characterised in that the area with an elastomeric layer thereon is surrounded by a rigid rim.

A die may have a single area with an elastomeric surface layer thereon, surrounded by a rigid rim at the edge of the die. It is also conceivable that there could be subdivision into a plurality of adjacent areas of elastomeric surface layer whose adjoining edges are separated by a shared rim portion.

In a development of this invention an elastomeric layer is provided by a piece of elastomer which is oversized, so as to be compressed by the rim. Such an oversized piece of elastomer will bulge slightly from the die but will be pressed back towards the die when it is brought into contact with detergent composition. The result will be an increase in the movement of the surface of the elastomer layer between each stamping operation which will tend to dislodge any particles of detergent composition which do manage to adhere to the elastomer.

The size of the piece of elastomer contained by the rim may be such that, when the die is not in contact with the detergent composition, the elastomer bulges sufficiently to create a cavity between its self and the die. Formation of a cavity between the elastomer and the die may be deliberately induced or exploited by providing an air passage leading into this cavity. Such a passage could allow air to vent from the cavity as the die comes into contact with the detergent composition during a stamping operation. The machinery could include provision for sucking air out of this cavity before the elastomer comes into contact with the detergent composition so as to hold the elastomer more firmly onto the die during stamping operation. Alternatively the machinery could have provision for blowing air into such a cavity to distend the elastomer slightly while it is out of contact with the detergent composition. On either basis the objective would be to increase the movement of the surface of the elastomer between a position when it is pushed against the die during stamping and a distended position when it is out of contact with the detergent composition, thus helping to dislodge any particles which do adhere to the surface of the elastomer.

This invention is applicable to compacted tablets of detergent composition for fabric washing. These will generally contain at least 5 wt % of organic surfactant together with at least 5 wt % of detergency builder.

When tablets are stamped, the rigid rim will form an indentation around the area of the tablet surface contacted by elastomer. The indentation will be less permeable than the face which it surrounds, as a consequence of being stamped by the rigid rim. However, this can be accepted without significant detriment to the rate of dissolution/disintegration of the tablet, because the surface area of this indentation can be small in proportion to the overall surface area of the tablet.

So, in a further aspect of this invention, there is provided a tablet of compacted particulate detergent composition for fabric washing characterised in that a face of the tablet is surrounded by an indentation.

Generally the surface formed by contact with the elastomer and circumscribed by the indentation will have higher permeability per unit area than the indentation itself. The indentation may be smoother than the face which it surrounds.

The face of a rim which contacts the detergent composition during compaction desirably has a width of at least 0.5 mm, preferably at least 1.0 mm, but not more than 2.5 mm.

Preferably the width is not more than 2.0 mm. A range of 1.3 to 1.9 mm has been found particularly suitable.

Correspondingly, the width of an indentation in the tablet surface will desirably lie in the range from 0.5 mm to 2.5 mm, preferably from 1.0 or 1.3 to 1.9 or 2.0 mm.

The surface area of a die which comes into contact with detergent composition may lie in a range from 750 to 4000 $mm^2$. Typically a tablet may be cylindrical, for example with a radius of 16 to 35 mm corresponding to a face area of 800 to 3850 $mm^2$ and then the radial extent of a rim and the indentation formed by it may be from 0.5 to 2.5 mm. Consequently the indentation may occupy less than 20% of the area of the face including the surrounding indentation. A rim with a radial extent of 0.5 mm on a tablet of 35 mm radius will be approximately 3% of the area of the tablet face.

DESCRIPTION OF EMBODIMENTS

Figure 1:
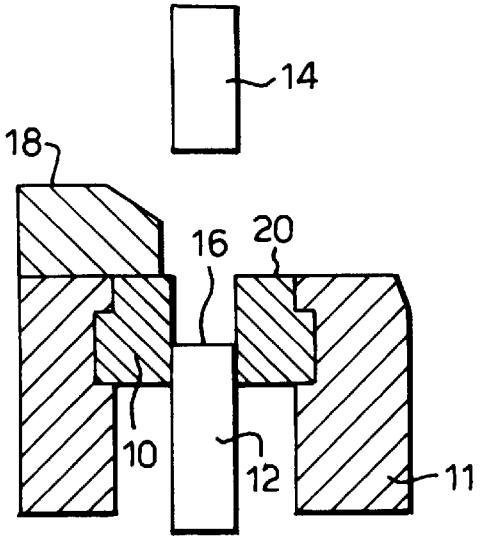
FIG. 1 is a vertical cross-section through a simple tablet press, illustrating its general arrangement.

As indicated earlier the invention is concerned with detergent tablets for use in fabric washing. Materials which may be included in the composition will be discussed below and embodiments of tablet and apparatus for tablet manufacture will be described by way of example.

Compositions

The particulate composition which is compacted may be a mixture of particles of individual ingredients, but usually will comprise particles which themselves contain a mixture of ingredients. Such particles containing a mixture of ingredients may be produced by a granulation or spray drying processes and may be used alone or together with particles of single ingredients.

A detergent composition will normally contain detergent active and detergent builder. Other ingredients are optional, but usually there will be some other ingredients in addition to the detergent active and detergency builder.

The amount of detergent active in a tablet is suitably from 2 to 60 wt % and is preferably from 5 or 8 wt % up to 40 to 50 wt %. Detergent-active material present may be anionic (soap or non-soap), cationic, zwitterionic, amphoteric, nonionic or any combination of these.

Anionic detergent-active compounds may be present in an amount of from 0.5 to 40 wt %, preferably from 2, 4 or 5% up to 30 or 40 wt %.

Synthetic (i.e. non-soap) anionic surfactants are well known to those skilled in the art. Examples include alkylbenzene sulphonates, olefin sulphonates; alkane sulphonates; dialkyl sulphosuccinates; and fatty acid ester sulphonates.

Primary alkyl sulphate having the formula $ROSO_3^-M^+$ in which R is an alkyl or alkenyl chain of 8 to 18 carbon atoms especially 10 to 14 carbon atoms and $M^+$ is a solubilising cation especially sodium, is commercially significant as an anionic detergent active. Linear alkyl benzene sulphonate of the formula

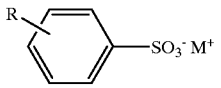

where R is linear alkyl of 8 to 15 carbon atoms and $M^+$ is a solubilising cation, especially sodium, is also a commercially significant anionic detergent active.

Frequently, such linear alkyl benzene sulphonate or primary alkyl sulphate of the formula above, or a mixture thereof will be the desired anionic detergent and may provide 75 to 100 wt % of any anionic non-soap detergent in the composition.

In some forms of this invention, the amount of non-soap anionic detergent lies in a range from 0.5 to 15 wt % of the composition.

It may also be desirable to include one of more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, copolymers of ethylene oxide and propylene oxide, and products made by condensation of ethylene oxide with the reaction products of propylene oxide and ethylene-diamine. Other so-called nonionic detergent compounds include long-chain amine oxides, tertiary phosphine oxides, and dialkyl sulphoxides.

Especially preferred are the primary and secondary alcohol ethoxylates, especially the $C_{10-15}$ primary and secondary alcohols ethoxylated with an average of from 5 to 20 moles of ethylene oxide per mole of alcohol.

In certain forms of this invention the amount of nonionic detergent lies in a range from 2%, better 4 or 5% up to 20%, 30% or 40% by weight of the composition.

Since many nonionic detergent compounds are liquids or low melting solids, these may be absorbed on a porous carrier. Preferred carriers include zeolite, sodium perborate monohydrate and Burkeite (spray-dried sodium carbonate and sodium sulphate as disclosed in EP 221776 (Unilever).

Although this invention may be employed with a variety of detergent compositions, problems of adhesion are solved in particular with compositions containing at least 5 wt % anionic surfactant and at least 2 wt % of ethoxylated fatty alcohol as nonionic surfactant, eg 5–30 and 2–20 wt % respectively.

Tablets of this invention also include detergency builder and this may be provided by water-soluble salts or by water-insoluble material.

Examples of water-soluble builders are sodium tripolyphosphate, pyrophosphate and orthophosphate; soluble carbonates, e.g. sodium carbonate; and organic builders containing up to six carbon atoms, e.g. sodium tartrate, sodium citrate, trisodium carboxymethyloxysuccinate.

If phosphate or polyphosphate detergency builder is used, it may provide at least 5% by weight, often at least 10% by weight of the overall composition.

Alkali metal (preferably sodium) aluminosilicates are water-insoluble builders. They may be incorporated in amounts of up to 60% by weight (anhydrous basis) of the composition, and may be either crystalline or amorphous of mixtures thereof, having the general formula:

$0.8–1.5Na_2O.Al_2O_3.0.8–6SiO_2$

These materials contain some bound water and are required to have a calcium ion exchange capacity of at least 50 mg CaO/g. The preferred sodium aluminosilicates contain 1.5–3.5 $SiO_2$ units (in the formula above).

Suitable crystalline sodium aluminosilicate ion-exchange detergency builders are described, for example, in GB 1429143 (Procter & Gamble). The preferred sodium aluminosilicates of this type are the well known commercially available zeolites A and X, the zeolite P described and claimed in EP 384070 (Unilever) which is also referred to as zeolite MAP and mixtures thereof. Zeolite MAP is available from Crosfields under their designation Zeolite A24.

Another water-insoluble detergency builder is crystalline layered sodium silicate as described in U.S Pat. No. 4664839.

Other builders may also be included in the detergent composition as necessary or desired. Water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts.

The total amount of detergency builder will generally lie in a range from 5 to 80 wt % of the composition. The amount may be at least 10 or 15 wt % and may lie in a range up to 50 or 60 wt %.

Detergent compositions which are compacted into tablets according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 1 to 30% by weight of the composition.

Perphthalimido perhexanoic acid and perdodecanoic acid are two examples of organic peroxyacids. Typically these can be used as 1 to 6% of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. Typically persalt is used as 5 to 30% by weight of a composition, while activator is 1 to 10% by weight of the composition.

A tablet of this invention may contain water-soluble material which serves to promote disintegration. Preferably this is provided as particles which are substantially free of organic surfactant.

One possibility is that such particles contain at least 50% of their own weight, better at least 80%, of a material which has a solubility in deionised water at 20° C. of at least 50 grams per 100 grams of water. Such particles may provide material of such solubility in an amount which is at least 5 wt % of the whole composition of the tablet.

A solubility of at least 50 grams per 100 grams of water at 20° C. is high solubility: many materials which are classified as water soluble are less soluble than this.

Some highly water-soluble materials which may be used are listed below, with their solubilities expressed as grams of solid to form a saturated solution in 100 grams of water at 20° C.:

| Material | Water solubility (g/100 g) |
|---|---|
| Sodium citrate dihydrate | 72 |
| Potassium carbonate | 112 |
| Urea | >100 |
| Sodium acetate | 119 |
| Sodium acetate trihydrate | 76 |
| Magnesium sulphate $7H_2O$ | 71 |
| Potassium acetate | >200 |

Another possibility is that particles which promote disintegration are particles containing at least 50% of their own weight better at least 80%, sodium tripolyphosphate with more than 50% of it (by weight of the particles) in the anhydrous phase I form. This is the phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A further preference is that such sodium tripolyphosphate is partially hydrated. The extent of hydration should be at least 1% by weight of the sodium tripolyphosphate in the particles. It may lie in a range from 2.5 to 4%. Suitable material is commercially available. Suppliers include Rhone-Poulenc, France and Albright & Wilson, UK.

Other ingredients may also be present in the overall composition. These include sodium carboxymethyl cellulose, colouring materials, enzymes, fluorescent brighteners, germicides, perfumes and bleaches. Sodium alkaline silicate may be included, although the amount of this or at least the amount added as an aqueous liquid, is preferably restricted so as to keep to a particulate mixture prior to compaction.

Granular detergent compositions of high bulk density can be prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever).

Shape and Strength

We have preferred to make tablets with a cylindrical shape in which the height of the cylinder is generally less than its diameter. One test of the strength of such tablets is the diametral fracture stress (DFS) determined using a testing machine which can urge the faces together with a measured force. The test was carried out by placing the cylindrical tablet between the platens of an Instron Universal Testing Machine, so that the platens contact the curved surface of the cylinder at either end of a diameter through the tablet. The sample tablet is then compressed diametrically, suitably by advancing the platens of the machine towards each other at a slow rate such as 1 cm/min until fracture of the tablet occurs at which point the applied load required to cause fracture is recorded. The diametral fracture stress is then calculated from the following equation:

$$\delta_O = \frac{2P}{\pi Dt}$$

where $\delta_O$ is the diametral fracture stress (Pa), P is the applied load to cause fracture (N), D is the tablet diameter (M) and t is the tablet thickness (M).

For any given tablet composition, tablet strength varies inversely to the air volume expressed as percentage of the whole volume. If tablets have a shape which is not cylindrical, their diametral fracture stress is defined as the diametral fracture stress of cylindrical tablets having the same composition and percentage air volume.

The present invention proves particularly useful when compacting tablets with sufficient pressure to achieve a diametral fracture stress or equivalent parameter of at least 8 KPa, better at least 10 KPa, and preferably not more than 60 KPa. A value not exceeding 25 or 30 KPa will usually be adequate. We have found that suitable compaction pressures to be applied by the tabletting press lie in a broad range from 3 to 60 MPa, preferably 4.5 to 35 MPa.

It is conceivable, but not preferred, that the elastomeric surface layer and surrounding rim could be provided on one die of a pair, or on a stationary counter member facing a single die, yet not on the die. Such arrangements would be expected to lead to asymmetric tablets in which one face was more permeable than the opposite face. This would still give the benefit of enhanced water penetration into the tablet, albeit through one, not both, faces.

Elastomers

Preferably the elastomer surface layer on one or more dies has a thickness at its periphery or over its whole area of at least 300 $\mu$m, better at least 400 $\mu$m or at least 500 $\mu$m. If provided as an insert, the elastomer preferably has a thickness at its periphery or over its entire area of at least 1 mm.

Elastomers are polymers which are deformable, but return to approximately their initial dimensions and shape upon release of the deforming force. Generally they are polymers with long flexible chains, with some cross-linking between chains so as to form a cross-linked network structure. The network structure restrains the movement of the macromolecular chain molecules and as a result recovers rapidly after deformation.

The term "elastomeric" includes materials as defined in ISO (International Standard Organisation) 1982 as an "elastomer", or "rubber". Also included in the definition of "elastomeric" materials according to the invention are thermoplastic elastomers and copolymers and blends of elastomers, thermoplastic elastomers and rubbers.

At low temperature, generally well below 0° C., elastomers are hard and brittle. Then with increasing temperature an elastomer goes through a rubbery phase after softening and retains its elasticity and elastic modulus until its decomposition temperature is reached. The material should of course be in its rubbery state at the operating temperature of the press.

Preferably the elastomeric material according to the invention is selected from those classes described in American Society for Testing and Materials D1418 which include:

1. Unsaturated carbon chain elastomers (R Class) including natural rubbers and butadiene acrylonitrile copolymer, e.g. "Perbunan" ex Bayer.
2. Saturated carbon chain elastomers (M Class) including ethylene-propylene types, e.g. "Nordel" ex DuPont and fluorine containing types, e.g. "Viton" ex DuPont.
3. Substituted silicone elastomers (Q Class), e.g. as available from Dow Corning.
4. Elastomers containing carbon, nitrogen and oxygen in the polymer chain (U Class), e.g. polyurethane ex Belzona.

Additional materials, for example fillers, can be incorporated in the elastomeric material to modify its mechanical and processing properties. The effects of filler addition depends on the mechanical and chemical interaction between the elastomeric material and the filler.

Fillers can be used to improve tear resistance for example. Suitable fillers include carbon blacks; silicas; silicates; and organic fillers such a styrene or phenolic resins. Other optional additives include friction modifiers and antioxidants.

An elastomeric insert is preferably made by moulding the elastomer in a separate mould. Technology for moulding elastomers to shape is well known.

Possibly an elastomeric insert could be cut from a sheet of elastomer, but this is less preferred.

Porosity

The step of compacting the particles reduces the porosity of the composition. Porosity is conveniently expressed as the percentage of volume which is air.

The air content of a tablet can be calculated from the volume and weight of the tablet, provided the air-free density of the solid content is known. The latter can be measured by compressing a sample of the material under vacuum with a very high applied force, then measuring the weight and volume of the resulting solid.

The percentage air content of the tablet varies inversely with the pressure applied to compact the composition into tablets while the strength of the tablets varies with the pressure applied to compact them into tablets. Thus the greater the compaction pressure, the stronger the tablets but the smaller the air volume within them.

The invention may be applied when compacting particulate detergent composition to give tablets with a wide range of porosities. Specifically included among possible porosities is a porosity of 17 or 20 better 25% up to 35% air by volume in the tablet.

Tablets of this invention may have porosity and surface permeability such that at least 65 of the void space within the tablet is filled with water within 30 seconds, upon partial immersion such that three quarters of the tablet surface is in contact with water.

Water Uptake

The speed with which water can penetrate into a tablet, which indicates whether interior porosity is open to the exterior through a permeable surface layer, can be assessed by a test of tablet wetting on partial immersion.

The following procedure is suitable:

A tablet is weighed, then supported on a wire mesh support within a container which is larger than the tablet. (The wire mesh support exposes more of the tablet surfaces than exposed than would be the case if the tablet was simply resiting on the base of the container.) Demineralised water, with coloured ink or dye dissolved in it, is poured into the container until it covers three quarters of the tablet surface. After 30 seconds the tablet is lifted out of the water, held for 5 seconds to allow water to drain off its surfaces, and weighed again. The increase in tablet weight is of course the weight of water taken up, and a measure of the speed with which water is taken up through capillary action. This volume of water is then expressed as a percentage of the air volume within the tablet.

The part of the tablet which was not immersed in water is inspected visually. If the void space within the tablet has become completely (or nearly completely) filled with water, then this part of the tablet will have become coloured with the dye in the water. If water has not penetrated fully into the tablet, the immersed surface of the tablet will be coloured by the dye, but part of the surface which remained dry will also remain free of dye.

Figure 7:
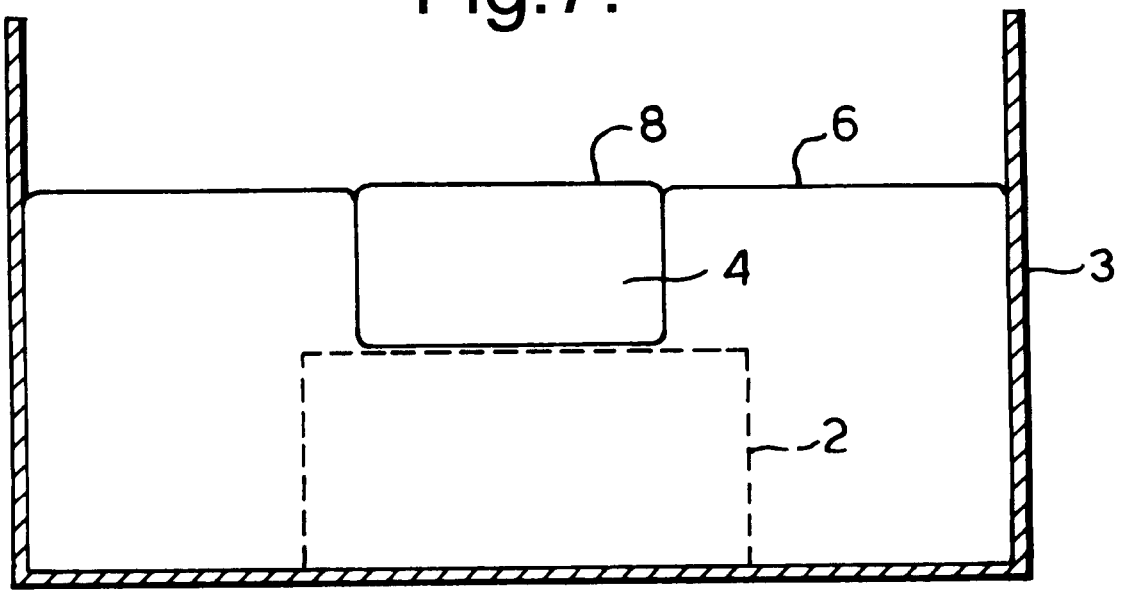
FIG. 7 illustrates a test procedure for water uptake.

FIG. 7 of the drawings illustrates the application of this test to a cylindrical tablet with a radius of 22 cm and a height of 20 cm.

A cylindrical dish 3 is used. A piece of wire mesh, aperture width 0.5 cm, is cut and shaped to provide a stand 2 within the dish. The tablet 4 for test is weighed and placed so that one flat face rests on this stand. Water containing a trace of black ink is poured into the dish almost up to a level 6, very close to the upper flat face 8 of the tablet. This face is approximately 25% of the tablet surface and remains exposed to air.

After a set time, usually 30 seconds, the tablet is removed, allowed to drain, and re-weighed to determine the weight of water taken up. (A qualitative indication, if the pores within the tablet did not fill completely with water, is that a circle at the centre of the face 8 of the tablet retains the original white colour of the tablet, while the rest of the tablet has the black colour of the ink).

It may be possible to support tablets in more than one orientation for partial immersion. If so, the orientation found to give greatest water uptake should be adopted for the test of wetting.

In practice, the extent of tablet wetting is not greatly affected by variation in the percentage surface are exposed to water, so that a useful result can be obtained when the percentage of the tablet surface covered by the water is anywhere from 70 to 80%.

It is desirable that in this test, at least 65%, better at least 80% of the void space within the tablet is filled with water within 30 seconds.

Factors Affecting Porosity and Wetting

As mentioned above, the porosity of tablets, i.e. their percentage air volume, varies inversely with the pressure applied to compact the composition into tablets while the strength of the tablets varies with that pressure.

The amount of pressure needed to obtain a desired porosity, (eg in the range from 25 to 35%) can be found by making tablets with varying amounts of applied force, and measuring the porosity of the tablets obtained.

Stamping Machinery

Tablets embodying the invention can be made using a conventional stamping press as diagramatically illustrated in FIG. 1 of the accompanying drawings. This tabletting press incorporates a tubular sleeve 10 into which fit a lower punch 12 and an upper punch 14. The punches are also referred to as dies. The sleeve 10 defines a mould cavity closed at its bottom by the lower punch 12. In use a particulate composition is supplied to this cavity by means of a filling shoe 18 which slides on the upper surface 20.

Initially the filling shoe delivers a particulate composition to fill the cavity 16 within sleeve 10 above the lower punch 12.

Next, the filling shoe withdraws to the position shown in FIG. 1 and the upper punch 14 is pressed down into the cavity within sleeve 10 thus compacting the particulate composition in the cavity to form a shaped tablet. Subsequently the upper punch is raised and the lower punch 12 is also raised to eject the tablet.

In accordance with this invention, the upper punch 12 and the lower punch 14 each have an elastomeric layer over most of their faces which come into contact with the detergent composition.

The sleeve 10, which also forms part of the mould, is made of steel and is not surfaced with elastomer. The punches 12,14 make sliding contact with this sleeve, as do tablets compacted in the mould.

Figure 2:
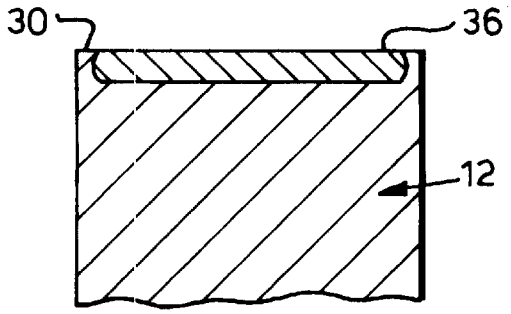
FIG. 2 is a schematic cross section of part of a die with an elastomeric insert in place.
Figure 3:
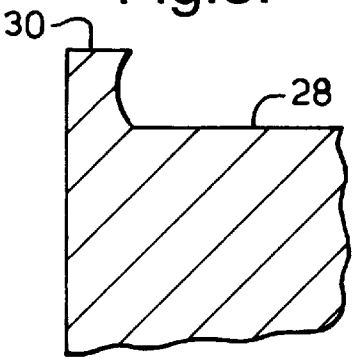
FIG. 3 is an enlarged detail without the insert.

As shown by FIGS. 2 and 3, each of the punches 12, 14 has a flat end face 28 surrounded by a rim 30 at the circumference of the punch and integral with it.

As best seen in FIG. 3, the rim 30 is undercut at its inside face 32. The elastomer is a pre-formed insert 36 about 2 mm thick. It is shown here as laminar, but it may be made thicker at its circumference than at its centre, to produce tablets with slightly domed faces. As shown in FIG. 2, such an insert can be pre-fitted into the space within the rim 30 so that it lies against the face 28 and is retained, without adhesive, by the undercut rim 30. The edge of the insert 36 closely abut the face 32 of rim 30.

During the stamping of tablets using such dies, the elastomer inserts will wear slowly. When necessary they can easily be replaced with new inserts.

Figure 4:
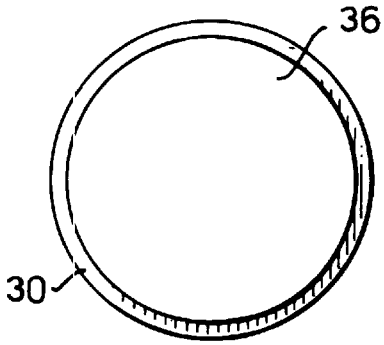
FIG. 4 is a face view of the die.
Figure 5:
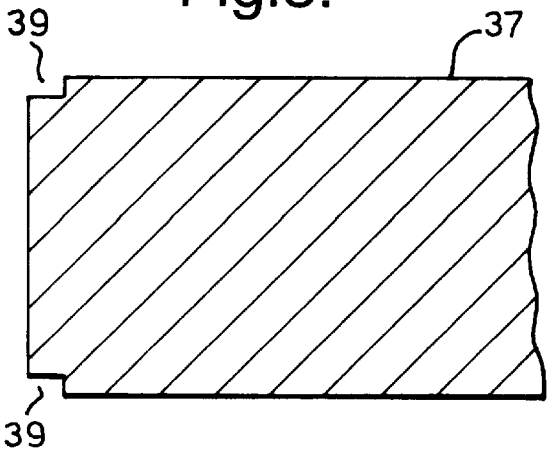
FIG. 5 is an enlarged cross section of part of a tablet.

When tablets are stamped, their cylindrical faces will be defined by the sleeve 10. Their end faces 37 which may be slightly domed, will be defined by the elastomer inserts 36 in the dies 12 and 14. At the circumference of each end face 37, the rigid rim 30 will create a small indentation 39 as shown in FIG. 4. This will occupy only a small fraction of the surface area of the end face 37. Because of this, a lower permeability, consequent on pressure from the rigid rim 30 rather than the elastomer 36, will have negligible effect on the speed with which tablets take up water, then disintegrate, at the time of use.

Figure 6:
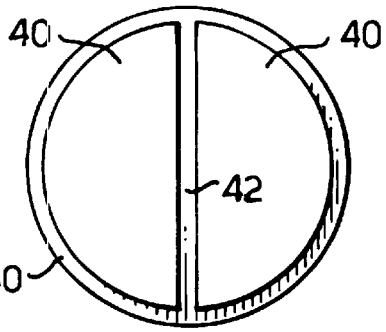
FIG. 6 is a face view of a different die.

FIG. 6 shows a variation. Instead of a single disc of elastomer 36 within rim 30, there are two D-shaped pieces of elastomer 40. Their adjacent straight edges abut a bar 42 which extends diametrally across the face of the die. The exposed face of this bar is level with the exposed face of the circumferential rim 36, which it joins at each end. This bar is undercut at both sides. Consequently each of the D-shaped pieces of elastomer is surrounded by a rim consisting of half the circumferential rim 30 plus the bar 40.

Figure 8:
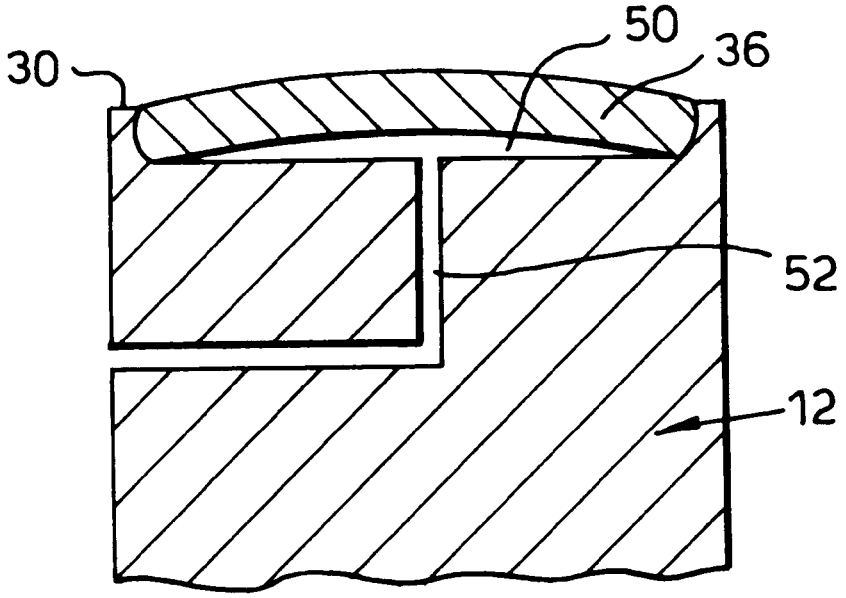
FIG. 8 is a cross section analogous to FIG. 2 illustrating use of an oversized piece of elastomer.

FIG. 8 illustrates the use of a piece of elastomer which is slightly oversized. FIG. 8 shows the relaxed condition of the elastomer when it is out of contact with detergent composition. The piece of elastomer 36 is slightly too large to fit within the space defined by the rim 30. Consequently it is compressed slightly inwardly when it is fitted within the rim and this makes it tend to bulge slightly outwardly from the die 12 as shown in FIG. 8. As shown in FIG. 8 this creates a small cavity 50 behind the elastomer 36. When the die is used to compress detergent composition into a tablet the force pushes the piece of elastomer 36 back against the die 12 so that it assumes the position as shown in FIG. 2.

To facilitate this movement of the piece of elastomer between the distended position as shown in FIG. 8 and a position firmly against the die as shown in FIG. 2, the die is formed with a small air passage 52 leading from the cavity 50 as shown and allowing air to enter and leave this cavity.

It would be possible to connect an air passage of this nature to a pump for sucking air out of the cavity and thereby holding the piece of elastomer in place or to a pump for delivering air into the cavity thereby promoting the distension of the piece of elastomer 36 while it is out of contact with the detergent composition which is being stamped into a tablet.

EXAMPLES

Example 1

A detergent powder with the following composition was prepared:

| | % by weight |
|---|---|
| Granulated Components | |
| coconut primary alkyl sulphate | 1.4 |
| coconut alcohol 3EO | 7.6 |
| coconut alcohol 6EO | 4.8 |
| zeolite A24 | 29.3 |
| soap | 2.9 |
| sodium carboxymethyl cellulase | 0.8 |
| sodium carbonate | 0.3 |
| water | 5.3 |
| Postdosed Components | |
| PEG 1500 | 4.3 |
| sodium percarbonate (borosilicate coated) | 19.5 |
| TAED granule | 4.2 |
| perfume | 0.6 |
| antifoam, fluorescer and heavy metal sequestrant | 4.0 |
| sodium citrate | 15.0 |

The materials listed as "granulated components" were mixed in a Fukae (Trade Mark) FS-100 high speed mixer-granulator. (Continuous granulation equipment could also be used, as could other machinery for granulating in batches.) The soap was prepared in situ by neutralisation of fatty acid with sodium hydroxide. The mixture was granulated and densified to give a powder of bulk density greater than 750 g/litre and a mean particle size of approximately 650 $\mu$m.

The powder was sieved to remove fine particles smaller than 180 $\mu$m and large particles exceeding 1700 $\mu$m. The remaining solids were then mixed with the powder in a rotary mixer, after which the perfume was sprayed on, followed by the PEG. The PEG was sprayed at about 80° C. onto the powder which was at about 22–26° C. (slightly above ambient because of frictional heating during granulation).

Detergent tablets were prepared by compaction of 50 g quantities of the detergent powder formulation. The tablets were of circular cross-section having a diameter of 4.5 cm and a thickness of approximately 2.5 to 3.1 cm.

Compaction of the detergent powder, to make tablets with diametral fracture stress of about 12 KPa is carried out using punches as shown in FIGS. 2 to 4 of the drawings.

Example 2

Tablets for use in fabric washing were made, starting with a spray-dried base powder of the following composition:

| Ingredient | PARTS BY WEIGHT |
|---|---|
| Sodium linear alkylbenzene sulphonate | 11.0 |
| $C_{13-15}$ fatty alcohol 7EO | 2.4 |
| $C_{13-15}$ fatty alcohol 3EO | 2.3 |
| Sodium tripolyphosphate* | 18.0 |
| Sodium silicate | 4.0 |
| Soap | 0.21 |
| Acrylate/maleate copolymer | 1.5 |
| Sodium sulphate, moisture and minor ingredients | balance to 45 |

*Added to the slurry as anhydrous sodium tripolyphosphate containing at least 70% phase II form.

This powder was then mixed with other ingredients as tabulated below. These included particles of sodium tripolyphosphate specified to contain 70% phase I form and contain 3.5% water of hydration (Rhodia-Phos HPA 3.5 available from Rhone-Poulenc).

| Ingredient | % by weight |
|---|---|
| Base powder | 45 |
| Sodium percarbonate granules | 15 |
| TAED granules | 3.4 |
| Anti-foam granules | 3.2 |
| Perfume, enzymes and other minor ingredients | 3.5 |
| Rhodiaphos HPA3.5 tripolyphosphate | 30 |
| Sodium carbonate | — |

40 g portions of this particulate composition were made into cylindrical tablets of 44 mm diameter, using an automated industrial press stamping about 4000 tablets per hour. The press was fitted with punches having elastomer inserts about 2 mm thick within a surrounding rim, generally as described and shown with reference to FIGS. 2 to 4 of the drawings.

The press was set to apply compaction force of approximately 10 KN corresponding to a pressure of about 6 or 7 MPa which was sufficient to produce tablets with a diametral fracture stress of about 25 KPa.

It was found that the press could be run for several hours without any significant quantity of detergent composition adhering to the punches.

Example 3

Tablets for use in fabric washing were made, starting with a granulated base powder of the following composition:

| | % by weight |
|---|---|
| Coconut alkyl sulphate | 20.33 |
| Nonionic detergent ($c_{13-15}$ fatty alcohol 7EO) | 11.09 |
| Soap | 3.60 |
| Zeolite A24 | 42.42 |
| Sodium carboxymethyl cellulose | 1.68 |
| Sodium carbonate | 5.11 |
| Sodium citrate dihydrate | 6.37 |
| Moisture and other minor ingredients | 9.4 |

This powder were mixed with other detergent ingredients as tabulated below.

| | % by weight |
|---|---|
| Base powder | 50.0 |
| Perborate monohydrate | 11.2 |
| TAED (83% active) granules | 4.35 |
| Phosphonate | 0.60 |
| Sodium carbonate | 2.0 |
| Na-disilicate (80%) | 3.7 |
| Antifoam granules | 2.5 |
| Fluorescer granules (15% active) | 1.0 |
| Acrylate maleate copolymer | 1.0 |
| Enzymes | 0.74 |
| Perfume | 0.45 |
| Sodium acetate trihydrate | 22.5 |

The resulting composition was made into tablets using a press fitted with punches generally as described and illustrated with reference to FIGS. 2 to 4 of the drawings. For stamping these tablets the press was set to apply a force of about 25 KN so that the compaction pressure was approximately 15 to 17 MPa, leading to tablets with a diametral fracture stress in a range from 30 to 45 KPa.

We claim:

1. In a process for the manufacture of tablets of detergent composition for fabric washing, comprising compacting a particulate detergent composition containing from 5 to 50 wt % surfactant and from 5 to 80 wt % detergency builder, in a mould comprising a pair of dies which are moveable relatively towards and away from each other, wherein at least one of the dies has an elastomeric layer on an area which contacts the composition, the improvement wherein said elastomeric layer has a surface which contacts outside said detergent composition and a peripheral edge around said surface and has a thickness of at least 0.3 mm at its said peripheral edge and wherein, at the peripheral edge of the said area with elastomeric layer thereon, said die has a rigid rim surrounding said area said rim having an inside face which is undercut and in contact with said peripheral edge of said elastomeric layer and a further face which contacts the detergent composition and has a width in a range from 0.5 to 2.5 mm, whereby said further face of said rim and said surface of said elastomer layer both contact said detergent composition during compaction thereof.

2. A process according to claim 1 wherein said rigid rim surrounding the elastomer is a metal rim integral with the main body of the die.

3. A process according to claim 1 wherein the elastomeric layer has a thickness of at least 0.5 mm over its entire area.

4. A process according to claim 1 wherein said elastomeric layer comprises a piece of elastomer which is oversized, so as to be compressed by said rim.

5. A process according to claim 1 wherein said elastomeric layer comprises a piece of elastomer which is oversized, so as to be compressed by said rim and retained by the undercut thereof.

6. A process according to claim 1 wherein said elastomeric layer is provided by a piece of elastomer which is retained by said undercut rim, and said die includes an air duct to allow passage of air to and from a cavity formed between said piece of elastomer and said die.

7. A process according to claim 1 wherein the detergent composition contains from 5 to 30 wt % anionic surfactant and from 2 to 10 wt % nonionic surfactant which is ethoxylated fatty alcohol.

8. In a process for the manufacture of tablets of detergent composition for fabric washing, comprising compacting a particulate detergent composition containing from 5 to 50 wt % surfactant and from 5 to 80 wt % detergency builder, in a mould comprising a pair of dies which are moveable relatively towards and away from each other, wherein at least one of the dies has a piece of elastomer on an area which contacts the composition, the improvement wherein said piece of elastomer has a surface which contacts outside said detergent composition and a peripheral edge around said surface and has a thickness of at least 0.3 mm at its said peripheral edge and wherein, at the peripheral edge of the said area with elastomer thereon, said die has a rigid rim surrounding said area said rim having an inside face which is undercut and contacts said peripheral edge of said piece of elastomer and a further face which contacts the detergent composition, whereby said further face of said rim and said surface of said piece of elastomer both contact said detergent composition during compaction thereof.

9. A process according to claim 8 wherein said piece of elastomer is oversized, so as to be compressed by said rim and retained by the undercut thereof.

10. A process according to claim 8 wherein said piece of elastomer is retained by said undercut rim, and said die includes an air duct to allow passage of air to and from a cavity formed between said piece of elastomer and said die.

11. A tablet of compacted particulate detergent composition containing from 5 to 50 wt % surfactant and from 5 to 80 wt % detergency builder, characterized in that a face of the tablet has an indentation around its periphery, said indentation having a width in a range from 0.5 mm to 2.5 mm and wherein the portion of said face enclosed within said indentation has higher permeability per unit are than the surface of the indentation itself.

12. A tablet according to claim 11 wherein the indentation has a smoother surface than the portion of said face enclosed within said indentation.

13. A tablet according to claim 11 wherein said face of a tablet has a surface area in a range from 750 to 4000 $mm^2$ and the portion of said face enclosed within said indentation is at least 80% of said surface area.

14. A tablet according to claim 11 which contains from 5 to 30 wt % anionic surfactant and from 2 to 10 wt % nonionic surfactant which is ethoxylated fatty alcohol.

* * * * *